US005649643A

United States Patent [19]

Ridgeway

[11] Patent Number: 5,649,643

[45] Date of Patent: Jul. 22, 1997

[54] FLEXIBLE CONTAINER HAVING A RETRACTABLE DISPENSER

[75] Inventor: Donna Ridgeway, Fort Erie, Canada

[73] Assignee: Daniel Barnabas Harasty, Stevensville, Canada

[21] Appl. No.: 276,314

[22] Filed: Jul. 18, 1994

[51] Int. Cl.[6] ..... B65D 35/56

[52] U.S. Cl. ..... 222/105; 222/185.1; 222/529

[58] Field of Search ..... 222/94, 96, 105, 222/106, 108, 129, 153, 156, 181, 185.1, 183, 505, 511, 528–530, 561

[56] References Cited

U.S. PATENT DOCUMENTS

| | | | |
|---|---|---|---|
| 2,390,822 | 12/1945 | Wren | 222/572 |
| 3,128,016 | 4/1964 | Ferri | 222/212 |
| 3,481,515 | 12/1969 | Booth et al. | 222/529 |
| 3,559,847 | 2/1971 | Goodrich | 22/107 |
| 3,690,522 | 9/1972 | Chlystun | 222/529 |
| 4,223,809 | 9/1980 | Martin | 222/96 |
| 4,548,337 | 10/1985 | Morris | 222/105 |
| 4,640,425 | 2/1987 | Cabernoch | 222/94 |
| 4,722,458 | 2/1988 | Van Dal | 222/529 |
| 4,817,824 | 4/1989 | LaFleur et al. | 222/105 |
| 4,830,205 | 5/1989 | Hammond et al. | 222/94 |
| 5,083,678 | 1/1992 | Waring | 222/105 |
| 5,125,542 | 6/1992 | Blanc | 222/561 |
| 5,184,759 | 2/1993 | Gill et al. | 222/529 |
| 5,248,067 | 9/1993 | Garcia | 222/561 |

*Primary Examiner*—Andres Kashnikow
*Assistant Examiner*—Philippe Derakshani
*Attorney, Agent, or Firm*—Donald W. Huntley

[57] ABSTRACT

A reclosable container for containing a liquid or powder product and for dispensing the product as desired is provided. The container includes a bag made of flexible material, at one end of which is a retractable neck portion. A dispensing cap having a biased slider arm slidably mounted on the dispensing cap is provided on the neck portion. The slider arm allows the product to be dispensed from the container as desired.

10 Claims, 7 Drawing Sheets

FLEXIBLE CONTAINER HAVING A RETRACTABLE DISPENSER

FIELD OF INVENTION

The present invention relates to a reclosable dispensing container for containing and dispensing of a liquid or powder product, and more particularly to a container having a retractable dispensing valve. The invention also relates to a dispensing unit for use with the container.

BACKGROUND OF THE INVENTION

A number of consumer items, such as liquid dishwashing soap, shampoo, powdered soap, etc. are sold to the consumer in rigid plastic containers. The consumer uses the product, discards the plastic container and purchases more product in a similar rigid plastic container. Recently, there has been a move to reduce the amount of plastic material discarded by selling product in flexible plastic bags to the consumer. These are generally referred to as "refills" in which the consumer, instead of discarding the rigid plastic container, merely buys a "refill" and fills the rigid plastic container with the product. The flexible plastic bag, which is made of much less plastic material, is discarded. The amount of plastic discarded is thus reduced.

One disadvantage to these flexible plastic bag "refills" is that the bag is discarded immediately and that the consumer must have previously purchased the product in a rigid plastic container. The consumer cannot, without difficulty, use the product while it is in the flexible plastic bag.

Another disadvantage with selling products in flexible plastic bags is that they are difficult to handle and to place properly on shelves e.g. on the shelves of the store selling the product. This is particularly so if the flexible plastic bag is provided with a pouring spout to assist in pouring the product out of the bag.

The prior art discloses a number of flexible bags for containing liquids or powders, including containers having pouring spouts and the like. For example, U.S. Pat. No. 2,390,822 issued to Wren discloses a paper bag with an opening that forms a spout in use. The pouring spout and bag allow powdered and granulated materials to be poured from the bag. The pouring spout is disposed in the central portion of one end and when the bag is turned upside down, the weight of the contents causes that end of the bag to extend out, at which time the spout is formed. When the desired quantity of material has been dispensed from the bag, the bag may be turned over to sit upon its end until further material is required.

U.S. Pat. No. 3,128,016 issued to Ferri discloses a container having a bellows-type dispensing spout. When the container is to be shipped, the bellows is compressed allowing the overall height of the container to be substantially reduced into the container.

U.S. Pat. No. 3,481,515 issued to Booth discloses a container having a flexible plastic spout. The container is made of metal and has a rigid top wall from which a flexible plastic spout extends into the container. A removable cap is located on the spout. When the cap is removed, the spout flexes upwardly to extend outside the container, thus, providing a spout that is originally imbedded into the container but which can be subsequently pulled out of the container.

U.S. Pat. No. 3,559,847 issued to Goodrich discloses a liquid container made of flexible plastic material having a central tent-like section from which a spout projects. The tent-like section can move from a retracted position to an outwardly projecting position, thereby exposing the spout.

U.S. Pat. No. 3,690,522 issued to Chlystun also discloses a container having a collapsible pouring spout on the top portion thereof. The spout is imbedded within the container and can subsequently be pulled out using the cap, thereby allowing the contents of the container to be poured. The cover of the pouring spout has a frictionally engaging cap whereby the pouring spout can be tightly reclosed and the contents retained for future use.

U.S. Pat. No. 4,640,425 issued to Cabernoch discloses a nursing container made of flexible plastic material. The container includes a nipple and the walls of the container are folded back to enclose the nipple within the walls. When the nursing container is to be used, a seal is removed, thereby exposing the nipple.

U.S. Pat. No. 4,830,205 issued to Hammond et al also discloses a nursing container made of flexible material. The container includes a nipple that is constructed so that it is retracted into the container. When the nipple is to be used, a seal is removed and the nipple is extended out of the container.

U.S. Pat. No. 5,080,260 issued to During discloses a container made of flexible plastic. The container has a spout that is not retracted into the container.

SUMMARY OF THE INVENTION

A container for containing a liquid or powder product and for dispensing the product as desired has now been found. The container includes a retractable valve that can be in a retracted or extended position.

More specifically, an aspect of the present invention provides a reclosable dispensing container for a product in liquid or powder form, comprising:

(a) a bag portion made of flexible material for containing said liquid or powder product, said bag portion being sealed at a first end and tapering to a dispensing valve at a second opposed end;

(b) said dispensing valve being biased towards a non-dispensing position and movable to a dispensing position, said dispensing valve having a dispensing end disposed away from the bag portion; and (c) the flexible material forming the bag portion and the attachment thereof to the dispensing valve being such that the dispensing valve is capable of being retracted into the bag portion.

In a preferred embodiment of the reclosable dispensing container of the invention, the dispensing valve is capable of being retracted into the bag portion at least to a distance such that the dispensing end of the valve is flush with the bag portion.

In a further embodiment of the container, a handle or other gripping or attachment means extends from the first end of the container.

In another embodiment, the container is a free-standing container, using the valve end as a base.

In another aspect, the present invention further provides a dispensing unit for a valved flexible container of a product in liquid or powder form, comprising:

(a) a back plate having a frontal face and a rear face;

(b) at least one retaining guide for retention of a valved flexible container, said guide being attached to the frontal face of the back plate and being capable of receiving said container, said guide having a support in its lower end for retaining the flexible container within the guide, said support having an orifice therein through which the valve of the container may protrude, said orifice having a valve backing plate extending downwardly therefrom disposed on the back plate side of the orifice, said valve backing plate extending downwards from the orifice for at least a major portion of said valve, said dispensing unit being adapted to be positioned for flow of product out of the container.

In a preferred embodiment of the dispensing unit of the invention, said guide is open or capable of being opened at its upper end for insertion of said container.

In another embodiment, said guide is a removable guide or said guide is hingably attached to the back plate and capable of being opened at its upper end for insertion of said container.

In a further embodiment, the guide has an open section disposed away from the back plate for viewing of the valved flexible container.

In a still further embodiment, the rear face of the back plate, opposed to the guide, is adapted to be attached to a vertical surface.

In yet another aspect, the present invention provides a kit comprised of a reclosable dispensing container and a dispensing unit, in which (A) the reclosable dispensing container comprises
  (a) a bag portion made of flexible material for containing said liquid or powder product, said bag portion being sealed at a first end and tapering to a dispensing valve at a second opposed end;
  (b) said dispensing valve being biased towards a non-dispensing position and movable to a dispensing position, said dispensing valve having a dispensing end disposed away from the bag portion; and
  (c) the flexible material forming the bag portion and the attachment thereof to the dispensing valve being such that the dispensing valve is capable of being retracted into the bag portion; and (B) the dispensing unit comprises
  (a) a back plate having a frontal face and a rear face;
  (b) at least one retaining guide for retention of a valved flexible container, said guide being attached to the frontal face of the back plate and being capable of receiving said container, said guide having a support in its lower end for retaining the flexible container within the guide, said support having an orifice therein through which the valve of the container may protrude, said orifice having a valve backing plate extending downwardly therefrom disposed on the back plate side of the orifice, said valve backing plate extending downwards from the orifice for at least a major portion of said valve, said dispensing unit being adapted to be positioned for flow of product out of the container.

BRIEF DESCRIPTION OF THE DRAWINGS

The present invention will be described with respect to the accompanying drawings in which like numerals denote like parts in the several views, and in which:

FIG. 12 view of a sliding bar for a valve.

DETAILED DESCRIPTION OF EMBODIMENTS

Figure 1:
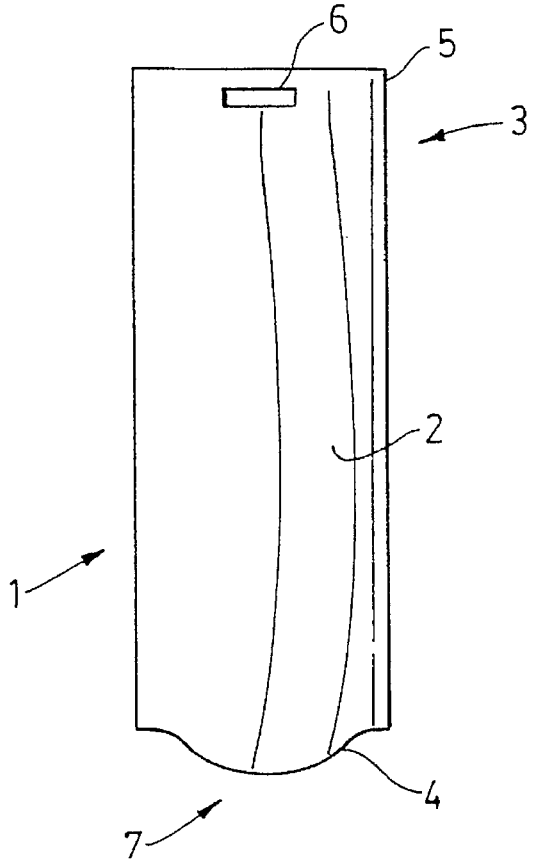
FIG. 1 is a schematic view of a reclosable dispensing container, with valve retracted

FIG. 1 shows a reclosable dispensing container, generally indicated by 1, comprised of bag 2 with first end 3 end and second end 4. First end 3 is shown as having flap 5 extending therefrom, flap 5 not containing any liquid or powder that may be packaged in the container 1. Flap 5 is shown as having an elongated orifice 6, for attachment to a dispensing unit. It is to be understood that elongated slot 6 may be replaced by slots of other shapes or other handles or attachment means for attaching reclosable dispensing container 1 to a dispensing unit or for convenience in carrying. The location of the dispensing valve is generally indicated by 7, although it is not shown in FIG. 1.

Figure 2:
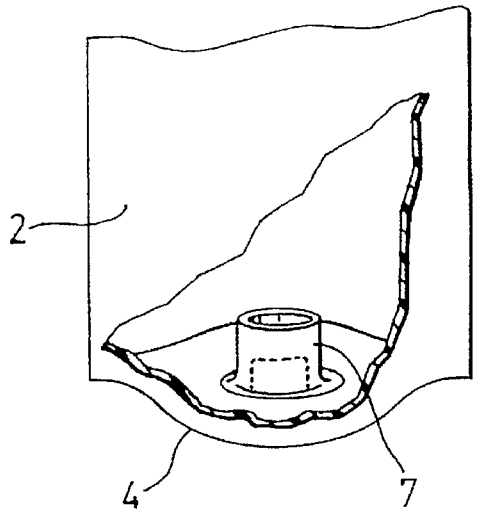
FIG. 2 is a partial section of a reclosable dispensing container showing the valve in retracted position.
Figure 3:
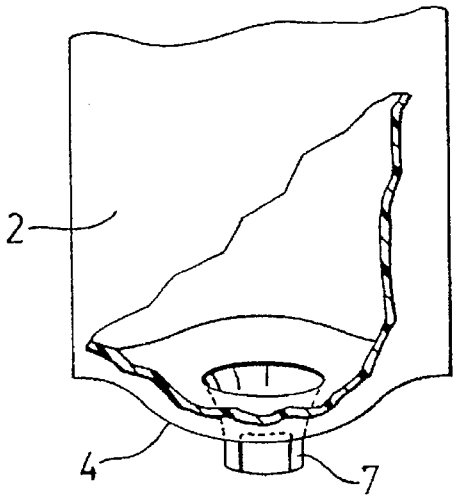
FIG. 3 is a partial section of a reclosable dispensing container showing the valve in an extended position.

FIG. 2 shows second end 4 of bag 2 as having dispensing valve 7 in a retracted position. Thus, dispensing valve 7 is located essentially enveloped by bag 2, and not extending beyond second end 4. In such a position, bag 2 is capable of being free-standing FIG. 3 shows dispensing valve 7 as extending beyond second end 4 of bag 2. This is the position that would be used at the time of dispensing of product from bag 2.

Figure 4:
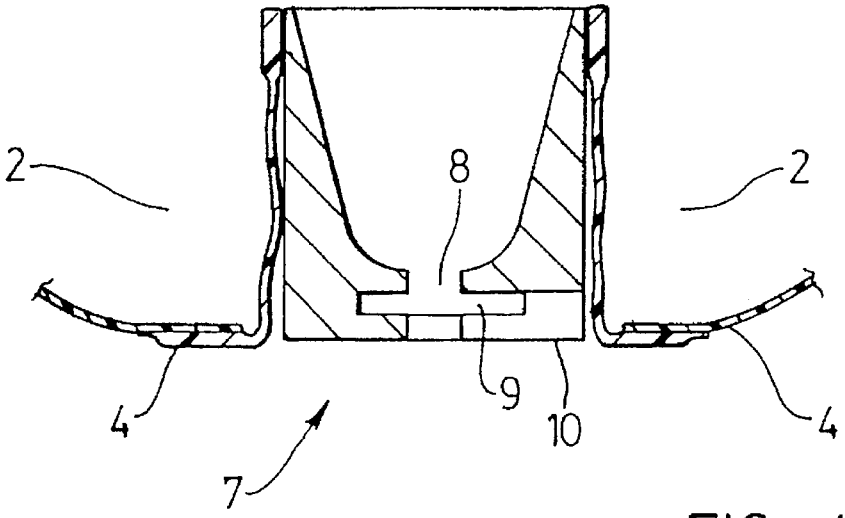
FIG. 4 is a partial cross-section of the reclosable dispensing container showing the valve in the retracted position.

FIG. 4 shows dispensing valve 7 in a retracted position. Dispensing valve 7 extends into pouch 2 from second end 4 such that second end 4 shrouds dispensing valve 7. In the embodiment shown in this drawing, lower end 10 of dispensing valve 7 is essentially flush with second end 4 of bag 2. Orifice 8 is shown as extending through dispensing valve 7, for discharge of the contents of the container. Valve slot 9 is the location where the valve would be; the valve is not shown in FIG. 4, for clarity.

Figure 5:
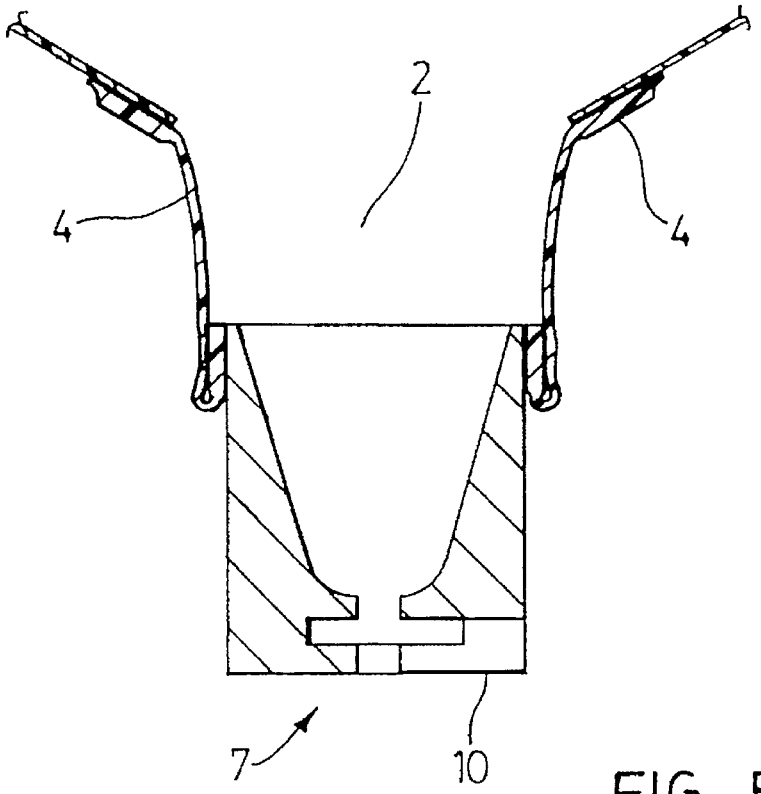
FIG. 5 is a partial cross-section of a reclosable dispensing container showing the valve in an extended position.

FIG. 5 shows dispensing valve 7 in an extended position, extending away from second end 4 of bag 2. In this position the lower end 10 of dispensing valve 7 is substantially away from second end 4 of pouch 2.

Figure 6:
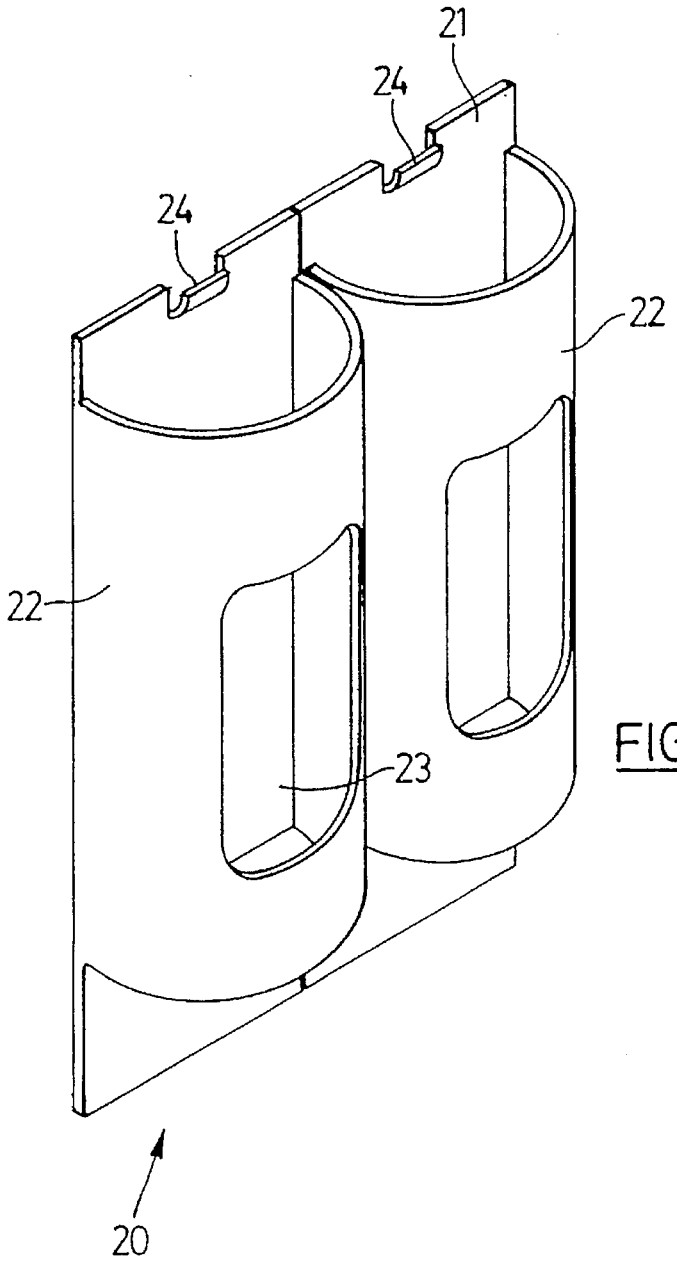
FIG. 6 a schematic representation of a dispensing unit with two guides.

FIG. 6 shows a dispensing unit, generally indicated by 20. Dispensing unit 20 has back plate 21 and, in the embodiment shown, two guides 22 attached to one surface of back plate 21. Back plate 21 is intended to be attached to a wall or other vertical surface in a manner not shown. In the embodiment shown, guide 22 is shown to be substantially semicircular in shape, although other shapes suitable for the retention of a valved flexible container could be used. Guide 22 has opening 23 in the front thereof, for the purpose of viewing the flexible container, and in particular viewing the amount of contents remaining in a flexible container inserted between the guide and the back plate. The upper portion of back plate 21 is shown as having tabs 24. Each tab is centrally disposed with respect to a guide 22, and is intended for attachment of a reclosable dispensing container e.g. by means of slots located within part of the dispensing container or other suitable means of attaching the container to the dispensing unit. Although the embodiment shown in FIG. 6 shows tabs, the tabs could be replaced by hooks or other suitable means for attaching a container.

Figure 7:
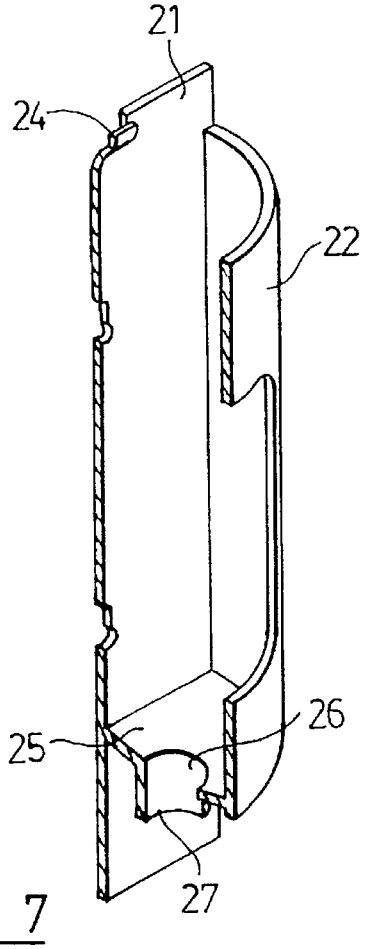
FIG. 7 is a vertical cross-section of one guide of a dispensing unit.

FIG. 7 shows a section through dispensing unit 20 of FIG. 6. Guide 22 is shown as open at its upper end, although this opening could be replaced with a lid that could be opened for insertion of a container and then closed thereafter. The lower part of guide 22 has plate 25, on which a flexible container would rest when within the dispensing unit. Plate 25 has a centrally located orifice 26. Extending from the orifice in a downward direction is valve backing plate 27. Valve backing plate 27 would only be placed on a portion of the orifice juxtaposed to back plate 21, and is used for the purpose of assistance when opening the valve in the flexible container within the dispensing unit.

Figure 8:
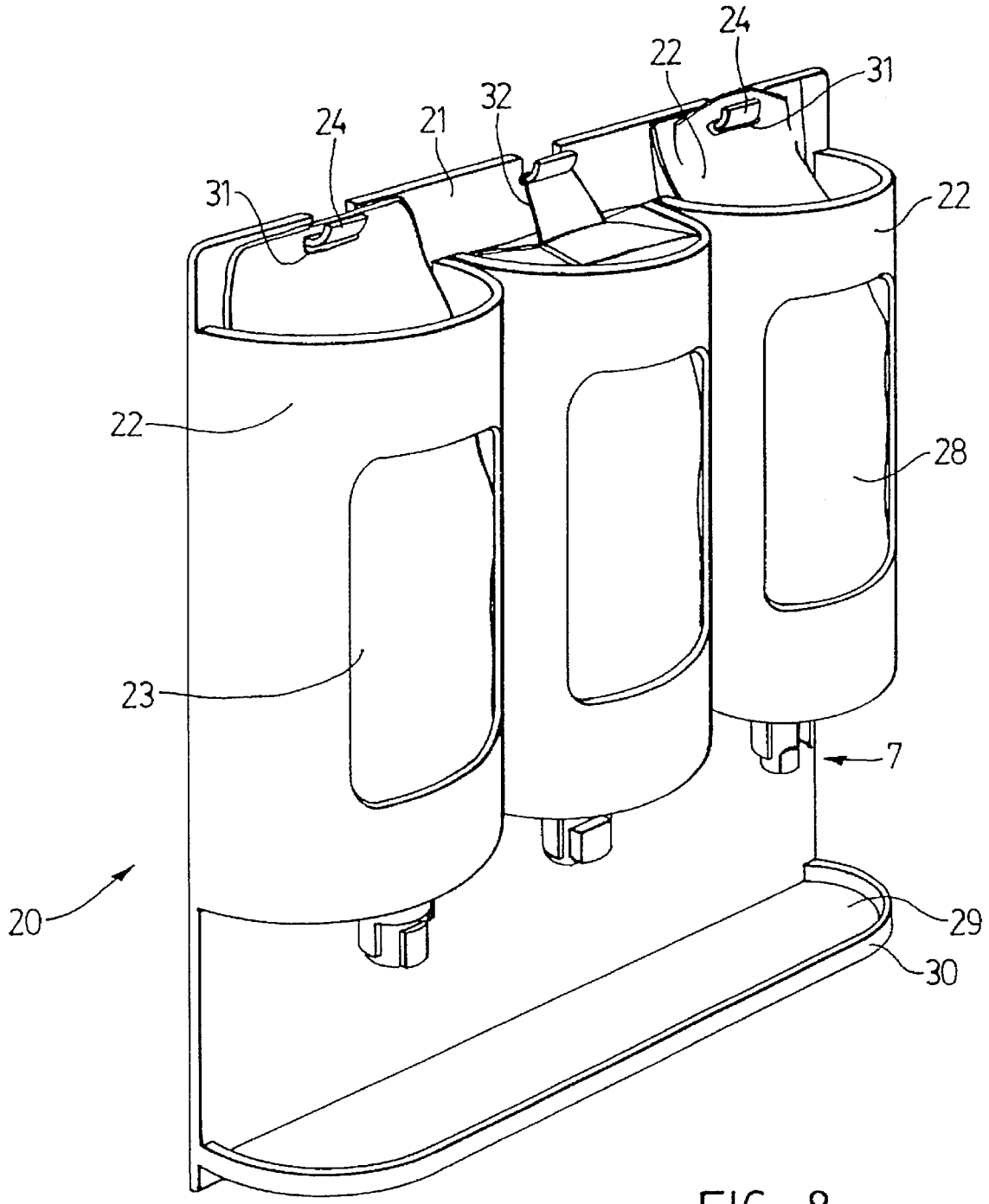
FIG. 8 is a schematic representation of a dispensing unit with three guides containing reclosable dispensing containers.

FIG. 8 shows a dispensing unit with three guides, adapted for the use with three separate flexible containers. Each container 28, shown with manufacturers logos to identify the product, is located within a guide 22, being attached to a tab 24 in the embodiment shown. The two outer containers as shown to have elongated slots in the upper end which pass over tab 24, whereas the container in the central guide is of a different construction and has cord 23 looped over tab 24. Dispensing valve 7 is shown as protruding below guide 22. Dispensing unit 20 is shown as having horizontal shelf 29 located beneath the dispensing valve 7, with a ledge around the edge of the shelf. Shelf 29 is conveniently located so that a receptacle may be placed on the shelf for receipt of fluid from the dispensing container. Shelf 29 further serves to catch any drips or minor spillages of the contents of the pouches.

Figure 9A:
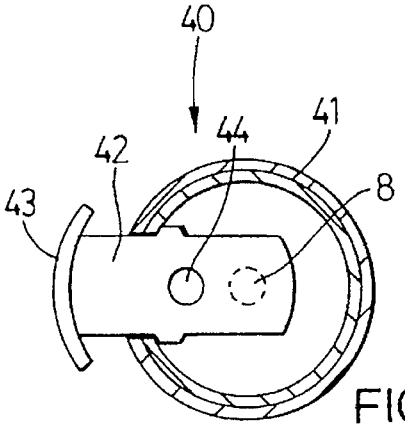
FIG. 9A is a cross-section of a valve in a closed position.

FIG. 9A shows a cross-section of dispensing valve 7. Slider arm 40 of dispenser valve 7, more clearly shown in FIG. 10A, has arm 42 with face plate 43 on the outer end thereof. The inner end of arm 42 is located within annular valve housing 41. Arm 42 has valve orifice 44 located therein, and in the embodiment shown in FIG. 9A, which is the valve in a closed position, orifice 8 of the dispensing valve is shown located at a position other than that of orifice 44 in arm 42.

Figure 9B:
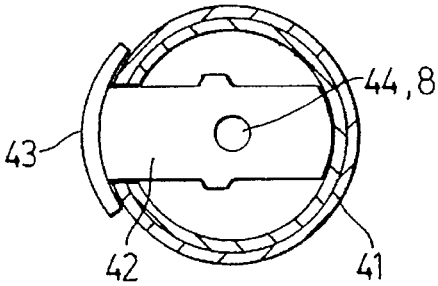
FIG. 9B is a cross-section of a valve in an open position.

FIG. 9B shows the embodiment of FIG. 9A in the open position wherein orifice 44 and orifice 8 are located in an aligned position.

Figure 10A:
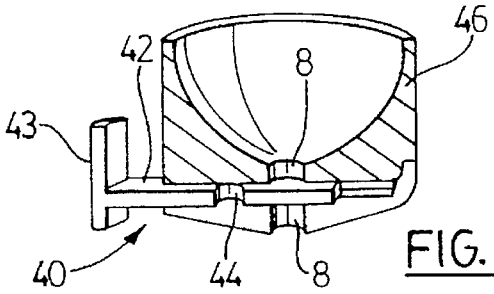
FIG. 10 is a vertical section of a valve in a closed position.
FIG. 10B is a vertical cross-section of a valve in an open position.

FIG. 10A shows a vertical cross-section of the dispensing valve 7. This figure shows the dispensing valve in a closed position, in which arm 42 is located in an out position such that orifice 44 is not aligned with orifice 8 of the dispensing valve.

Figure 10B:
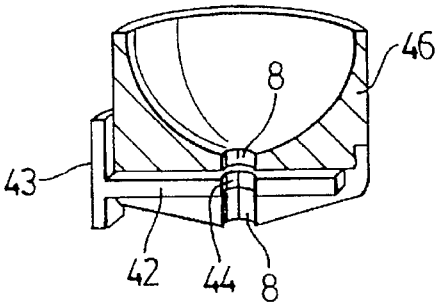

FIG. 10B shows the dispensing valve 7 in an open position with orifice 8 aligned with orifice 44.

Figure 11:
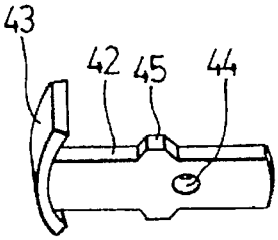

FIG. 11 shows arm 42 in a side elevational view showing face plate 43 and orifice 44. Arm 42 is shown as having valve nodules 45 for the purpose of ease of location of the arm during use.

Figure 12A:
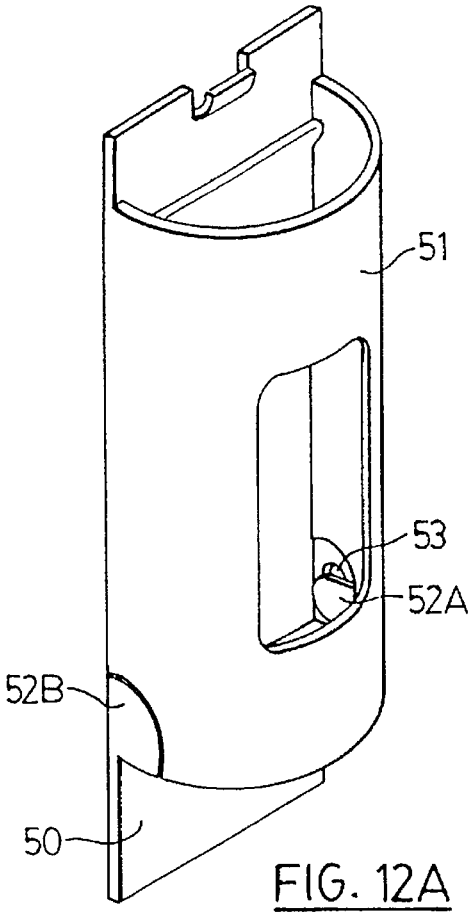
FIG. 12A is a view of a dispensing unit with hinged guide in closed and locked position.
Figure 12B:
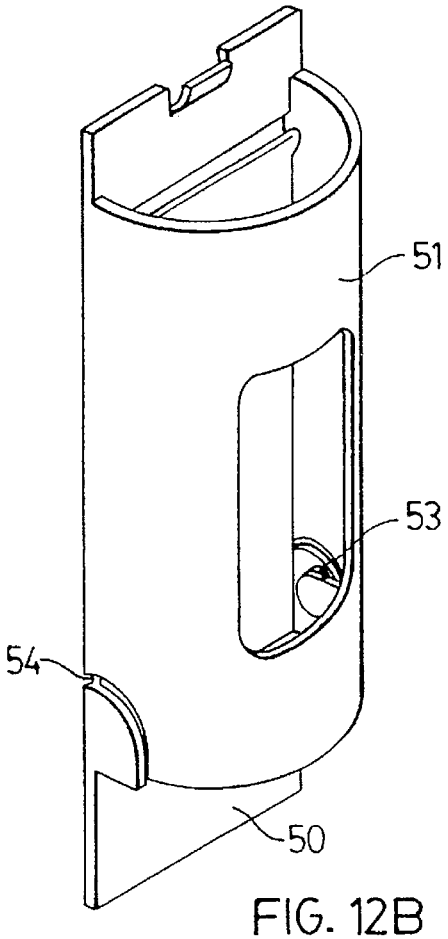
FIG. 12B is a view of a dispensing unit with hinged guide in closed and unlocked position.

FIG. 12A shows a dispensing unit with back plate 50 and guide 51. Guide 51 is attached to back plate 50 by hinge 52, shown in the interior of guide 51 as 52A and on the exterior as 52B. Hinge 52A is slidable in hinge slot 53, being in a locked position when in the lower part of hinge slot 53 and in an unlocked position when in the upper part of hinge slot 53. FIG. 12A shows guide 51 in the locked position and FIG. 12B shows guide 51 in the unlocked position. In the latter, curved slot 54 has formed between guide 51 and hinge 52B.

Figure 12C:
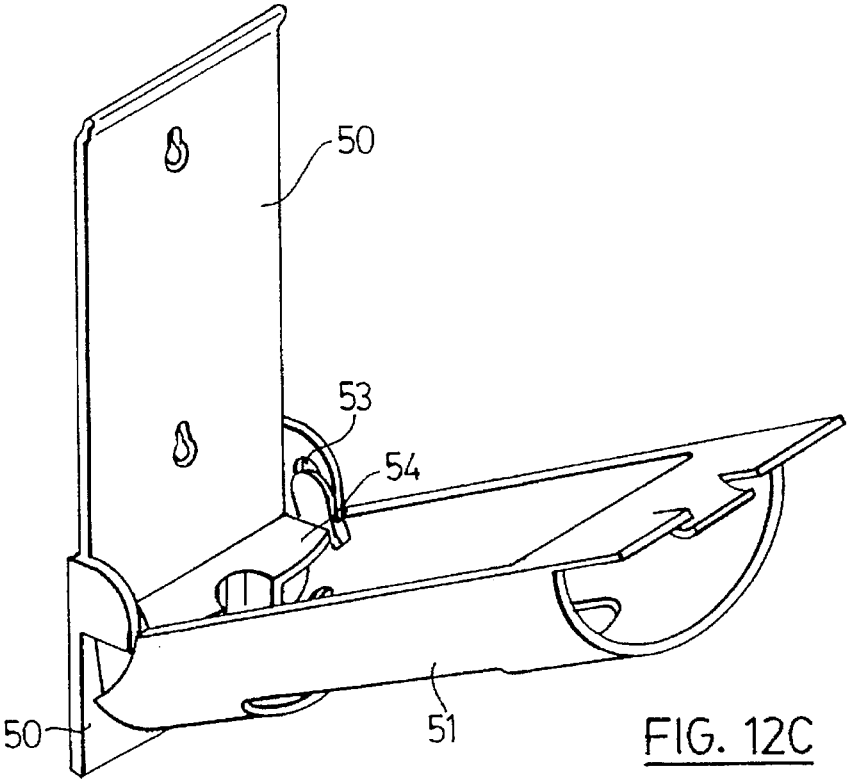
FIG. 12C is a view of a dispensing unit with hinged guide in an open position.

FIG. 12C shows guide 51 in an open position, having been rotated about hinge 52 to allow insertion of a container. The container would rest on plate 54, as described above.

Figure 13:
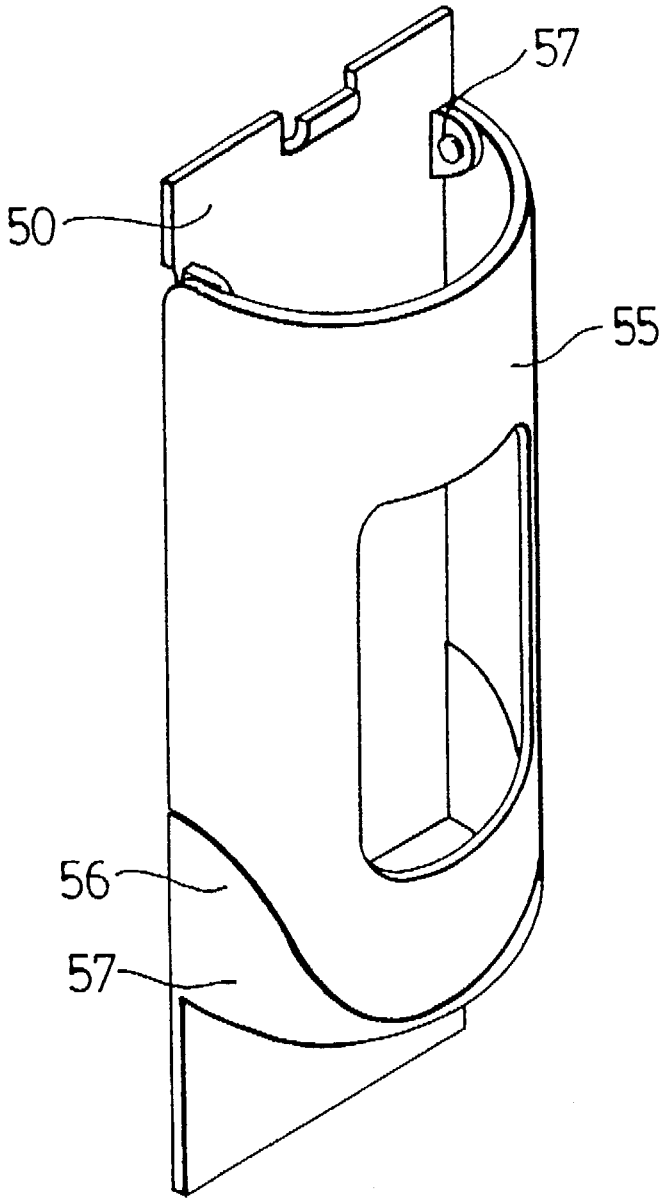
FIG. 13 is a view of an alternate dispensing unit with hinged guide.

FIG. 13 shows back plate 50 with guide 55 being hinged at the top of guide 55, as opposed to being hinged at the bottom as described above with respect to Fig. 12A. Guide 55 separates from base 57 along parting line 56. In this embodiment, guide 55 would rotatably open upwards away from back plate 50 for insertion of a container.

The invention has been described herein with particular reference to a spring-actuated valve e.g. the valve shown in the drawings. However, other valves may be used, including pump valves, rotatable valves, slider valves and the like, provided that the valve can be retracted as described herein.

The reclosable container made be made of any flexible material suitable for the packaging of the product. For instance, for liquids, the material might be polyethylene, polypropylene, polyvinyl chloride (also commonly referred to a vinyl) and other polymers, in single or multiple layer structures. Alternatively, the container could be made of paper. It is preferred that the material be transparent, at least in part, to permit viewing of the amount of product remaining in the container. In addition, the material of the reclosable container needs to be sufficiently flexible so that the valve may be retracted into the bag, to the extent that the valve is at least flush with the bottom of the bag and the bag is capable of being placed and remaining in a free-standing position on its valved end e.g. when placed on a flat surface for example a shelf.

The reclosable containers, and the dispensing unit, may be used in a variety of end-uses, including dispensing of laundry detergent, bleach and the like, juices, cosmetics, shampoo, hair conditioners, shower soap gels, dish soap, hand soap and hand cream.

I claim:

1. A reclosable dispensing container for a consumer product in liquid or powder form, comprising:

(a) a bag portion having opposed first and second ends made of flexible material for containing said liquid or powder product, said bag portion being sealed at the first end and tapering to a dispensing valve at the second opposed end, said dispensing valve having a slider arm, orifice, face plate, and valve nodule;

(b) said dispensing valve being biased towards a non-dispensing position and movable to a dispensing position, said dispensing valve having a dispensing end disposed away from the bag portion;

(c) the flexible material forming the bag portion and the attachment thereof to the dispensing valve being such that the dispensing valve is capable of being retracted into the bag portion at least to a distance such that the dispensing end of the valve is flush with the bag portion, said bag portion, free standing on its second end and having gripping means attached to and extending from the first end of the bag portion, and said container being a free-standing container, having a base, and wherein the second opposed end of the bag portion is at the base; and wherein the dispensing valve comprises a slider arm moveable between the non-dispensing position and the dispensing position.

2. The container of claim 1 in which the container is a free-standing container, using the valve end as a base.

3. The container of claim 1 in which said bag portion is capable of flexing to move the dispensing valve between a retracted position and an extended position, such that in the retracted position the dispensing valve is enveloped to an extent that the bag may be placed with its dispensing valve end on a surface without the valve contacting the surface, and such that in the extended position the valve is capable of dispensing product.

4. A dispensing unit for a valved free standing flexible container of a product in liquid or powder form, comprising:

(a) a back plate having a frontal face and a rear face;

(b) at least one retaining guide for retention of a valved free standing flexible container, said guide being attached to the frontal face of the back plate and being capable of receiving said container, said guide having a support in its lower end for retaining the flexible container within the guide, said support having an orifice therein through which the valve of the container may protrude, said orifice having a valve backing plate extending downwardly therefrom disposed on the back plate side of the orifice, said valve backing plate extending downwards from the orifice for at least a major portion of said valve, said dispensing unit being adapted to be positioned for flow of product out of the container.

5. The dispensing unit of claim 4 in which said guide is open or capable of being opened at its upper end for insertion of said container.

6. The dispensing unit of claim 4 in which said guide is removable from the frontal face of the back plate.

7. The dispensing unit of claim 4 in which the guide is hingably attached to the back plate and capable of being opened for insertion of said container.

8. The dispensing unit of claim 4 in which the guide has an open section disposed away from the back plate for viewing of the valved flexible container.

9. The dispensing unit of claim 4 in which the rear face of the back plate, opposed to the guide, is adapted to be attached to a vertical surface.

10. A kit for a liquid or powder consumer product comprised of a reclosable dispensing container and a dispensing unit, in which (A) the reclosable dispensing container comprises (a) a bag portion having opposed first and second ends and made of flexible material for containing said liquid or powder product, said bag portion being sealed at the first end and tapering to a dispensing valve at the second opposed end;

(b) said dispensing valve being biased towards a non-dispensing position and movable to a dispensing position, said dispensing valve having a dispensing end disposed away from the bag portion; and (c) the flexible material forming the bag portion and the attachment thereof to the dispensing valve being such that the dispensing valve is capable of being retracted into the bag portion at least to a distance such that the dispensing end of the valve is flush with the bag portion, said container having gripping means attached to and extending from the first end of the container, and said container being a free-standing container, having a base, and wherein the second opposed end of the bag portion is at the base;

(B) the dispensing unit comprises (a) a back plate having a frontal face and a rear face;

(b) at least one retaining guide for retention of a valved flexible container, said guide being attached to the frontal face of the back plate and being capable of receiving said container, said guide having a support in its lower end for retaining the flexible container within the guide, said support having an orifice therein through which the valve of the container may protrude, said orifice having a valve backing plate extending downwardly therefrom disposed on the back plate side of the orifice, said valve backing plate extending downwards from the orifice for at least a major portion of said valve, said dispensing unit being adapted to be positioned for flow of product out of the container.

* * * * *